US005148131A

United States Patent [19]

Amboss et al.

[11] Patent Number: 5,148,131

[45] Date of Patent: Sep. 15, 1992

[54] COAXIAL-TO-WAVEGUIDE TRANSDUCER WITH IMPROVED MATCHING

[75] Inventors: Kurt Amboss, Pacific Palisades; Stephen L. Hart, Torrance, both of Calif.

[73] Assignee: Hughes Aircraft Company, Los Angeles, Calif.

[21] Appl. No.: 714,550

[22] Filed: Jun. 11, 1991

[51] Int. Cl.[5] ..... H01P 5/103

[52] U.S. Cl. ..... 333/26; 333/253

[58] Field of Search ..... 333/21 R, 22 R, 26, 333/33-35, 248, 253

[56] References Cited

U.S. PATENT DOCUMENTS

| | | | |
|---|---|---|---|
| 2,588,103 | 3/1952 | Fox | 333/33 X |
| 2,829,352 | 4/1958 | Hennies et al. | 333/253 X |
| 3,478,282 | 11/1969 | Smith | 333/26 X |
| 4,139,828 | 2/1979 | Commault et al. | 333/26 |
| 4,740,764 | 4/1988 | Gerlack | 333/26 |
| 5,004,990 | 4/1991 | Bergero et al. | 333/22 R |

*Primary Examiner*—Paul Gensler

*Attorney, Agent, or Firm*—Terje Gudmestad; W. K. Denson-Low

[57] ABSTRACT

An end portion (14*a*) of a center conductor (14) of a coaxial cable (16) protrudes transversely into a tubular waveguide (10) near an end thereof. A piston (22) having a stepped inner wall (24) closes the end of the waveguide (10). The inner wall (24) is formed with two or more steps (24*a*,24*b*,24*c*) which protrude axially into the waveguide (10) by different distances (L1,L2,L3), reducing the return loss and extending the bandwidth of the coaxial cable-to-waveguide transition.

12 Claims, 4 Drawing Sheets

COAXIAL-TO-WAVEGUIDE TRANSDUCER WITH IMPROVED MATCHING

BACKGROUND OF THE INVENTION

1. Field of the Invention

The present invention relates to a transducer for coupling an electromagnetic signal between a coaxial cable and a waveguide.

2. Description of the Related Art

Coaxial cables and waveguides are used extensively for transmission of electromagnetic signals at microwave and other frequencies, and are suitable for different types of applications. It is often necessary to couple an electromagnetic signal from a coaxial cable to a waveguide or vice-versa. A coupler or transducer is required to perform this transition with minimum signal loss and maximum bandwidth.

Most coaxial-to-waveguide couplers can be classified into three general types, as described in an article entitled "Design of Simple Broad-Band Wave-Guide-to-Coaxial-Line Junctions", by S. Cohn, in Proceedings of the I. R. E., Sep. 1947, pp. 920–926. In the first type, the inner and outer conductors of the coaxial line contact opposite respective walls of the waveguide. In the second type, the inner conductor projects as a probe only part way into the waveguide. In the third type, the inner conductor connects to a coupling loop inside the waveguide.

The second type of coupler, to which the present invention most closely relates, is described in greater detail in an article entitled "IDEAL W. G. TO COAX TRANSITIONS USING A F. B. M. MONOPOLE", by F. De Ronde, in 1988 IEEE MTT-S Digest, pp. 591–594. With reference being made to present FIGS. 1 and 2, a waveguide 10 includes an elongated hollow tubular wall 12 having a rectangular cross-section. The tubular wall 12 includes an upper wall 12*a*, a lower wall 12*b*, and side walls 12*c* and 12*d* which are joined together at their adjacent edges. The wall 12 may be formed as a single piece by metal extrusion or other suitable process. Alternatively, the walls 12*a*, 12*b*, 12*c* and 12*d* may be fabricated separately and joined together by welding or the like.

The lower wall 12*d* of the tubular wall 12 is formed with a hole 12*e*. An end portion 14*a* of a center conductor 14 of a coaxial cable 16 protrudes into the waveguide 10 through the hole 12*e*. The cable 16 is joined to the waveguide 10 by a conventional connector which is not shown in the drawing.

The end portion 14*a* of the center conductor 14 acts as a transducer probe. An electromagnetic signal propagating through the coaxial cable 16 is electromagnetically induced into the waveguide 10 through coupling between the end portion 14*a* and the waveguide 10. Conversely, an electromagnetic signal propagating through the waveguide 10 is electromagnetically induced into the coaxial cable 16 through the end portion 14*a*.

The end portion 14*a* protrudes into the waveguide 10 adjacent to an end wall 12*f* of the tubular wall 12 which constitutes a short. In order to match the coaxial cable 16 to the waveguide 10 with minimum signal loss and maximum bandwidth, the geometry of the transition must be designed precisely.

As illustrated in the drawing, the main dimensions which affect the coupling between the coaxial cable 16 and waveguide 10 are the height H and width W of the inner cross-section of the tubular wall 12, the distance L between the center of the end portion 14*a* and the end wall 12*f*, the distance h by which the end portion 14*a* protrudes into the interior of the waveguide 10 above the inner surface of the lower wall 12*d*, the diameter 2*a* of the end portion 14*a*, and the diameter 2*b* of the hole 12*e*.

It is also possible to adjust the coupling by offsetting the end portion 14*a* right or left of the center position as viewed in FIG. 2, although this results in increased signal loss. Other expedients for adjusting the coupling as described in the article to De Ronde include providing shunt or series capacitance stubs in the waveguide 10 adjacent to the end portion 14*a*.

The distance L is generally on the order of ¼ wavelength at the desired operating frequency, and has a major effect on the bandwidth of the transition. However, the optimal distance L is a function of numerous complex variables and is generally determined empirically. The end wall 12*f* is shown as being constituted by the inner end of a plunger or piston 18 which slidably fits inside the tubular wall 12 and facilitates fine tuning of the assembly by adjusting the distance L. Some of the factors which affect the optimal distance L and a simplified design procedure are described in an article entitled "The Optimum Piston Position for Wide-Band Coaxial-to-Waveguide Transducers", by W, Mumford, in Proceedings of the I. R. E, Feb. 1953, pp. 256–261.

SUMMARY OF THE INVENTION

The present invention improves on the prior art described above by providing an additional means for adjusting the coupling in a coaxial-to-waveguide transducer which has been determined to reduce the signal loss and increase the bandwidth of the transition.

More specifically, a coaxial-to-waveguide transducer embodying the present invention includes a waveguide having an elongated tubular wall with an end. A coaxial cable includes a center conductor. Means are provided for coupling an electromagnetic signal between the center conductor of the coaxial cable and the interior of the waveguide adjacent to the end thereof. A stepped wall closes the end of the tubular wall.

The stepped wall has at least two step portions which protrude axially into the waveguide by different distances.

The coupling between the coaxial cable and waveguide may be accomplished by having an end portion of the center conductor protrude transversely into the waveguide through the tubular wall to constitute a probe. The stepped wall is preferably constituted by the inner end of a piston which slidably fits inside the tubular wall to facilitate adjustment of the distance between the end portion of the center conductor and the stepped wall.

A ceramic dome window may be fitted over the end portion of the center conductor to hermetically isolate the coaxial cable from the interior of the waveguide. The waveguide may be provided with a step transformer to match the impedance of the coaxial cable to the impedance of the waveguide.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
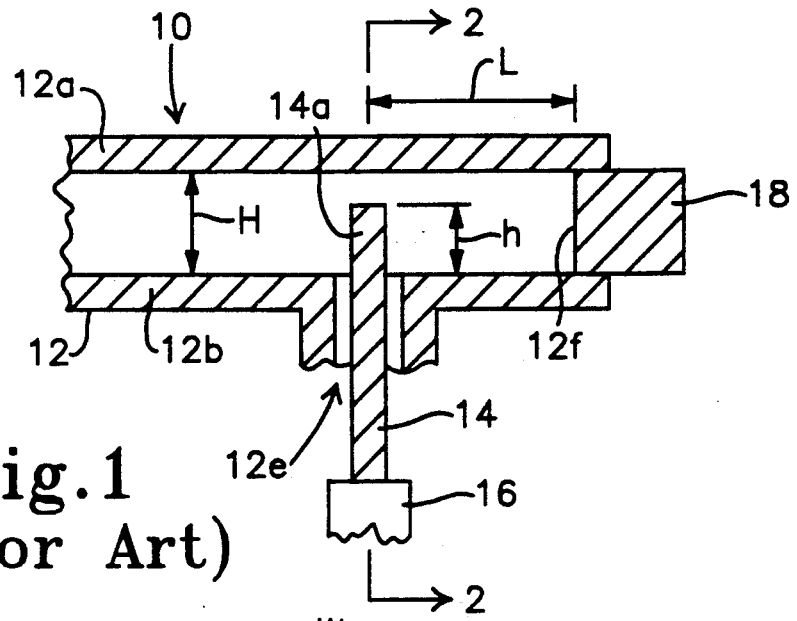
Fig.1 (Prior Art)
FIG. 1 is a longitudinal sectional view illustrating a prior art coaxial-to-waveguide transducer.
Figure 2:
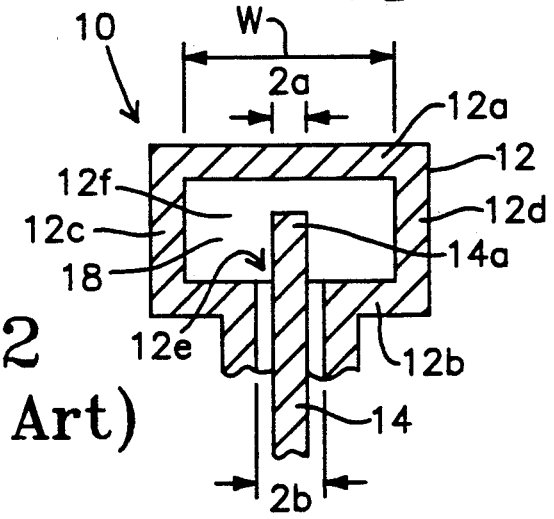
Fig.2 (Prior Art)
FIG. 2 is a transverse sectional view taken on a line 2—2 of FIG. 1.
Figure 3:
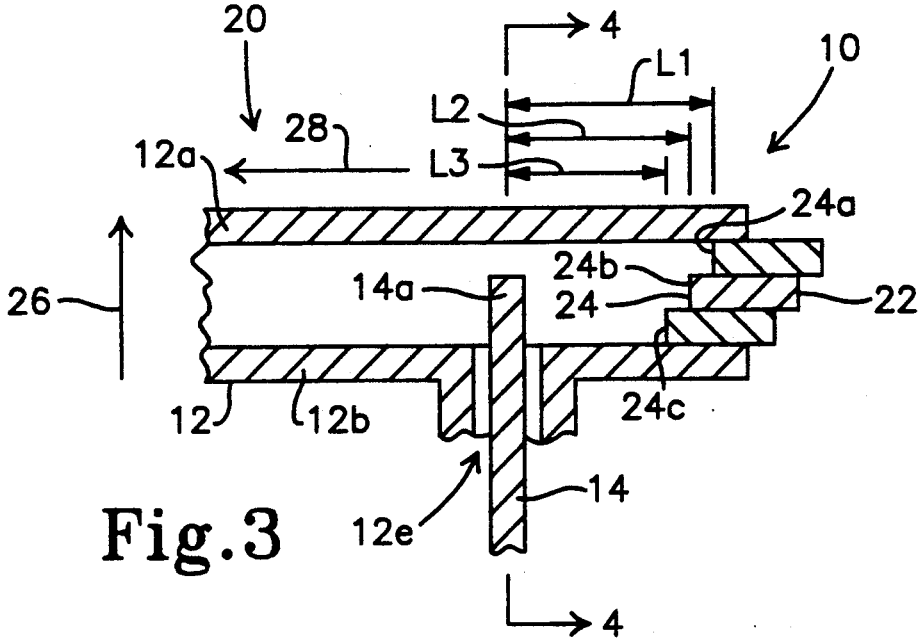
FIG. 3 is a longitudinal sectional view illustrating a coaxial-to-waveguide transducer embodying the present invention.
Figure 4:
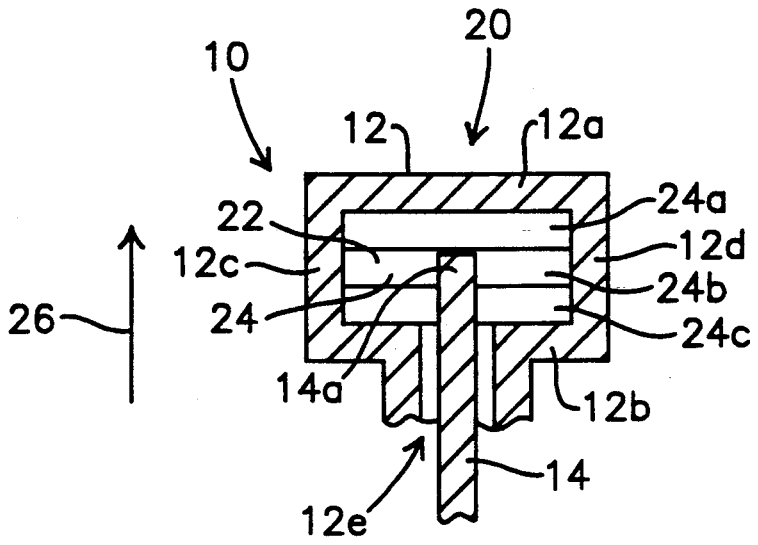
FIG. 4 is a transverse sectional view taken on a line 4—4 of FIG. 3.

FIGS. 3 and 4 illustrate a transducer 20 embodying the present invention including elements which are common to those illustrated in FIGS. 1 and 2 and are designated by the same reference numerals. In the present transducer 20, the piston 18 is replaced by a piston 22 having an inner end which constitutes a stepped wall 24.

As viewed in FIG. 3, the end portion 14*a* of the center conductor 14 protrudes into the waveguide 10 in a transverse direction as indicated by an arrow 26. The stepped wall 24 of the piston 22 is formed with three steps 24*a*, 24*b* and 24*c* which protrude axially into the waveguide 10 by different distances. The axial direction is indicated by an arrow 28. As illustrated, the step 24*b* protrudes into the waveguide 10 in the axial direction 28 further than the step 24*a*, whereas the step 24*c* protrudes further into the waveguide 10 than the step 24*b*.

Whereas the distance L between the center of the end portion 14*a* and the end wall 12*f* in the prior art arrangement illustrated in FIG. 1 has a single value since the wall 12*f* is flat, the steps 24*a*, 24*b* and 24*c* each different distance corresponding to L. In FIG. 3, the distance between the step 24*a* and the center of the end portion 14*a* is designated as L1, with the corresponding distances for the steps 24*b* and 24*c* being designated as L2 and L3 respectively.

Figure 5:
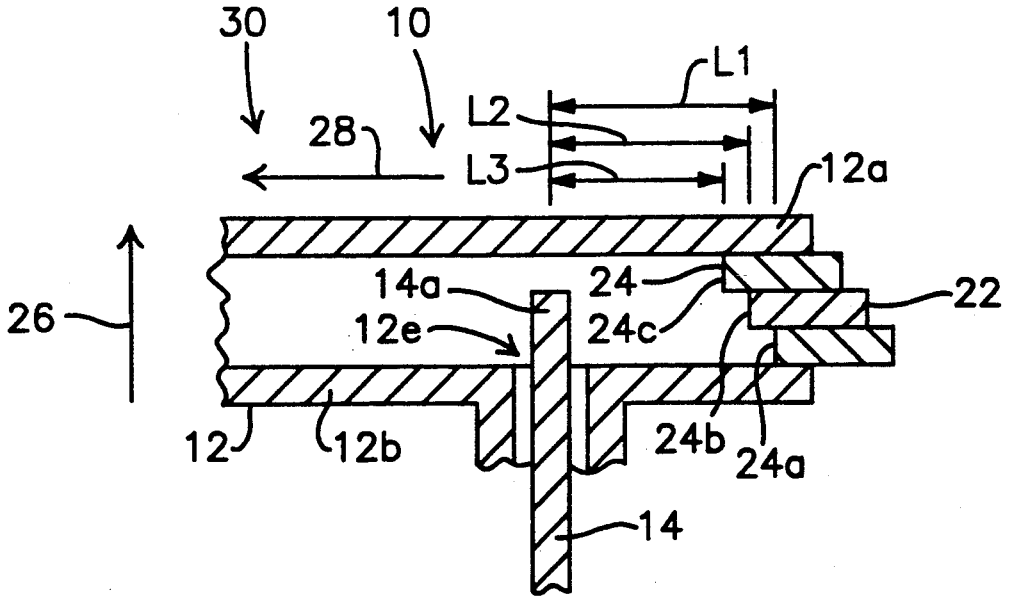
FIG. 5 is a longitudinal sectional view illustrating another embodiment of a coaxial-to-waveguide transducer of the present invention.

In the transducer 20, the steps 24*a*, 24*b* and 24*c* of the stepped wall 24 protrude into the waveguide 10 by progressively decreasing distances in the transverse direction 26. FIG. 5 illustrates another transducer 30 embodying the present invention in which the piston 22 is inverted such that the steps 24*a*, 24*b* and 24*c* of the stepped wall 24 protrude into the waveguide 10 by progressively increasing distances in the transverse direction.

The scientific principle by which the stepped end wall 24 improves the matching and bandwidth of the coaxial-to-waveguide transition is not fully understood, and the phenomenon itself was discovered experimentally. The scope of the invention includes providing the stepped wall 24 with two or more steps which protrude axially into the waveguide 10 by different distances. The variables involved are extremely complex, and the particular number, arrangement, and dimensions of the steps are determined most efficiently in actual practice by empirical procedures.

Figure 6:
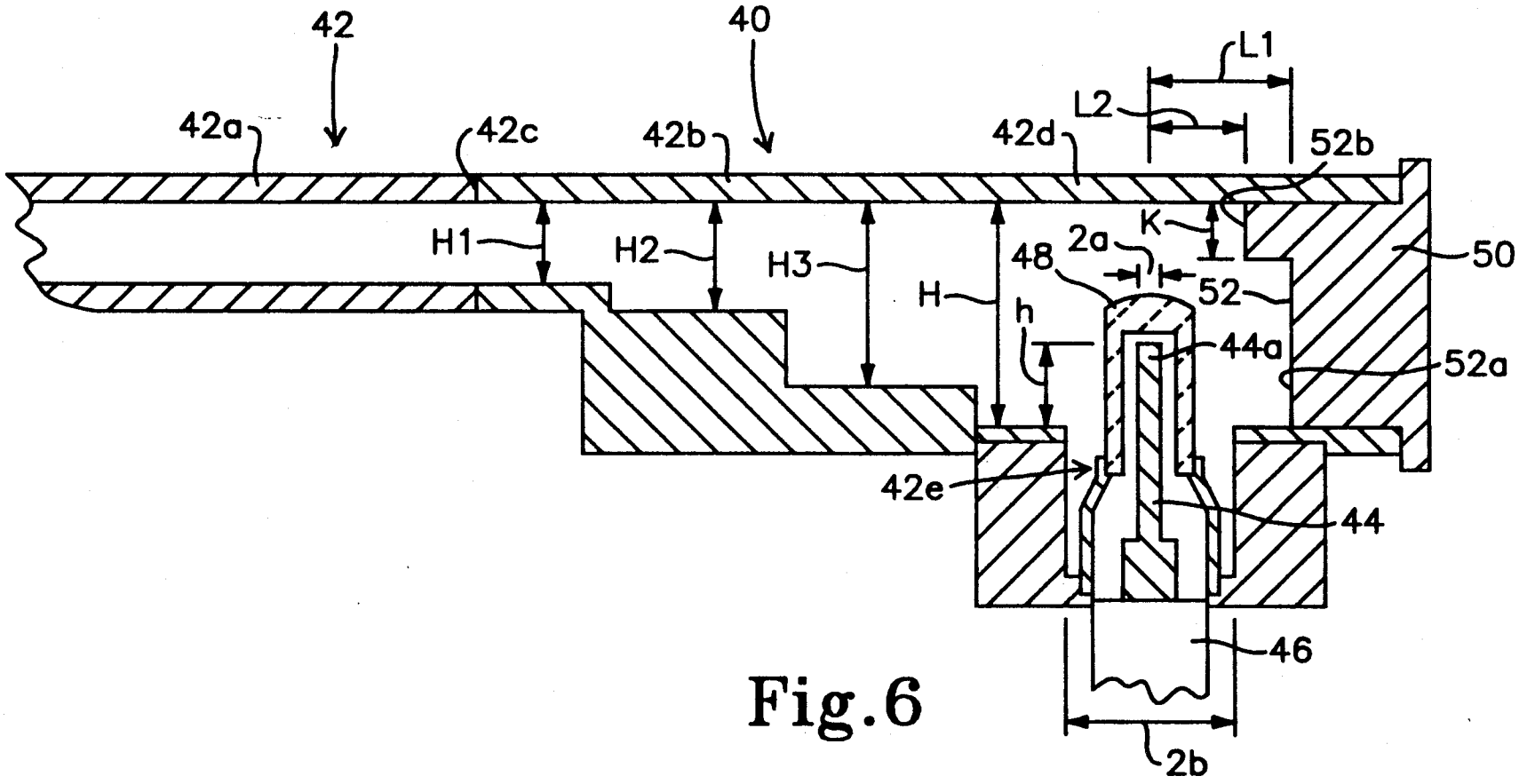
FIG. 6 is a longitudinal sectional view, to an enlarged scale, illustrating another embodiment of a coaxial-to-waveguide transducer of the present invention.

FIG. 6 illustrates a coaxial-to-waveguide transducer 40 which was constructed and tested in accordance with the present invention. The transducer 40 includes an elongated tubular waveguide 42 having a main transmission section 42*a* which is connected to a step transformer section 42*b* at 42*c* by brazing or the like. A transducer section 42*d* communicates with the end of the transformer section 42*b* opposite the transmission section 42*a*.

An end portion 44*a* of a center conductor 44 of a coaxial cable 46 protrudes transversely into the transducer section 42*d* through a hole 42*e* in the manner described above. The cable 46 is joined to the transducer section 42*d* by a conventional connector which is not shown in the drawing. A ceramic dome window 48 is fitted over the end portion 44*a* to hermetically isolate the coaxial cable 46 from the interior of the waveguide 42. A piston 50 is slidingly fitted into the right end of the transducer section 42*d* as viewed in FIG. 6, and has an inner end which constitutes a stepped end wall 52 of the waveguide 42.

The step transformer section 42*b* is provided to match the characteristic impedance of the coaxial cable 46, which is conventionally 50 ohms, to that of the main transmission section 42*a* of the waveguide 42, which in the present example is 120 ohms. Step transformers are known in the art per se, as described in an article entitled "Optimum Design of Stepped Transmission-Line Transformers", by S. Cohn, in I.R.E. Transactions—Microwave Theory and Techniques, Apr. 1955, pp. 16–21.

The wall 52 is formed with a step 52*a*, and a step 52*b* which protrudes axially into the waveguide 42 further than the step 52*a*. The height K of the step 52*b* was 23 mm. The distance L1 from the step 52*a* to the center of the end portion 44*a* of the center conductor 44 was 57 mm. The distance L2 from the step 52*b* to the center of the end portion 44*a* was 38 mm.

Regarding the other dimensions of the transducer 40, the height H was 102 mm, the distance h was 37 mm, the width W (not illustrated) was 229 mm, the diameter 2*a* of the center conductor 44 was 13 mm, and the diameter 2*b* of the hole 42*e* was 64 mm. The height of the inner cross-section H1 of the transmission section 42*a* of the waveguide 42 was 36 mm. The step transformer section 42*b* had two intermediate steps with inner cross-section heights H2 and H3 of 47 mm and 78 mm respectively. The transducer 40 with these dimensions was designed to operate at a center frequency of 10.5 GHz.

Figure 7:
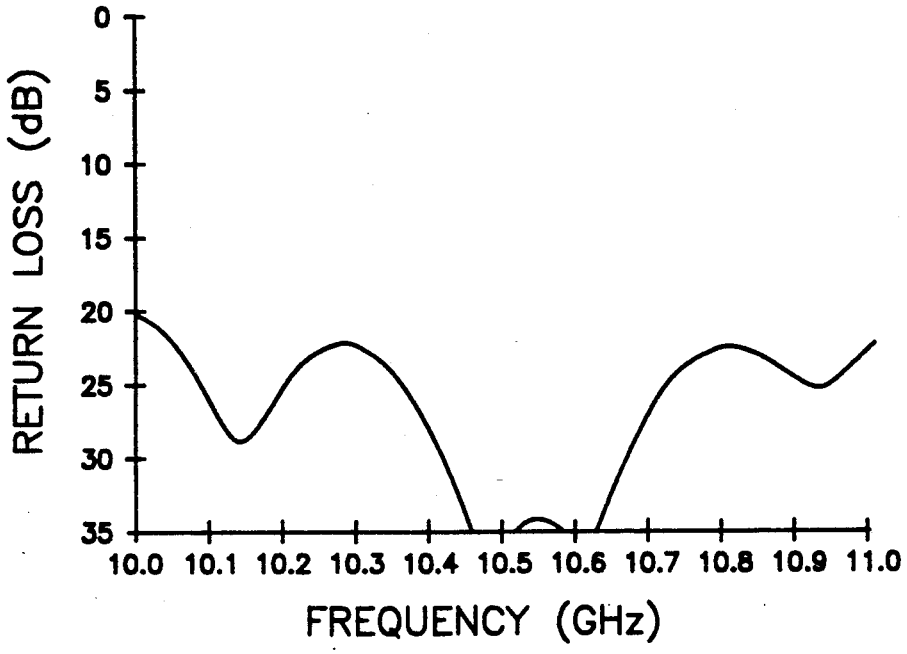
FIG. 7 is a graph illustrating the performance of the transducer illustrated in FIG. 6 without the improvement of the present invention.

FIG. 7 illustrates the performance of the transducer 40 with the piston 50 replaced by a piston (not shown) having a flat inner end as in the prior art illustrated in FIG. 1 located at a distance L of 57 mm (equal to L1 in FIG. 6) from the center of the end portion 44*a*. It will be seen in FIG. 7 that the return loss was never better than −20 dB over the entire frequency range of 10 to 11 GHz.

Figure 8:
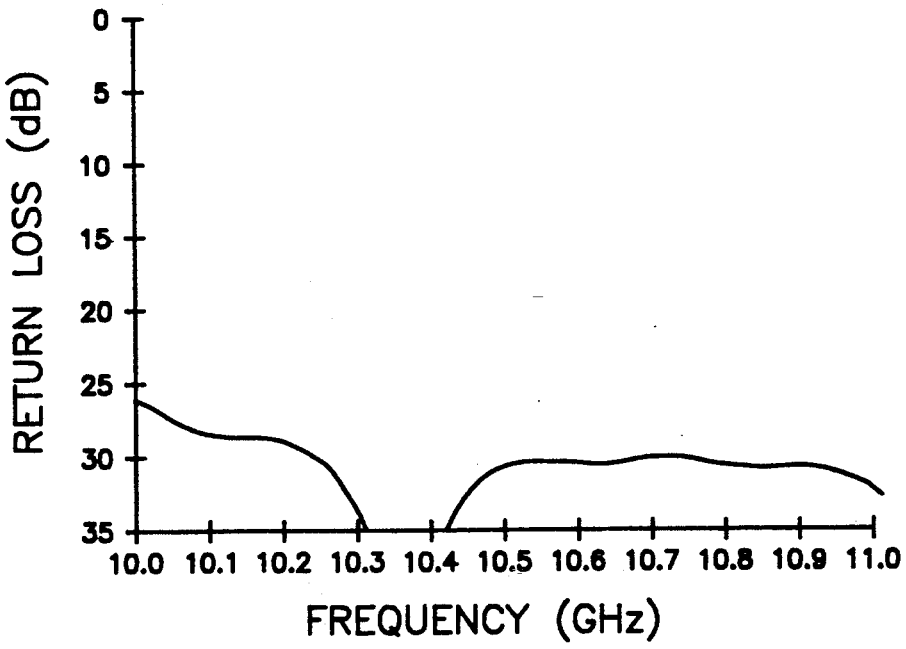
FIG. 8 is a graph illustrating the performance of the transducer illustrated in FIG. 6 including the improvement of the invention.

FIG. 8 illustrates the performance of the transducer 40 incorporating the stepped piston 50 as described with reference to FIG. 6. It will be seen in FIG. 8 that the return loss has been reduced by a factor of 5 dB over the frequency range of 10 to 11 GHz as compared with FIG. 7, thereby extending the usable bandwidth of the transition.

While several illustrative embodiments of the invention have been shown and described, numerous variations and alternate embodiments will occur to those skilled in the art, without departing from the spirit and scope of the invention.

For example, although the invention has been described and illustrated as being applied to a transducer in which the inner conductor projects as a probe only part way into the waveguide, the principle of the invention may be applied to transducers using other types of coupling. As described above with reference to the teachings of Cohn, the inner and outer conductors of the coaxial line may contact opposite walls of the waveguide, or the inner conductor may connect to a coupling loop inside the waveguide.

Accordingly, it is intended that the present invention not be limited solely to the specifically described illustrative embodiments. Various modifications are contemplated and can be made without departing from the spirit and scope of the invention as defined by the appended claims.

We claim:

1. A coaxial-to-waveguide transducer, comprising:

a waveguide including an elongated tubular wall having an end;

a coaxial cable including a center conductor having an end portion which protrudes into the waveguide through the tubular wall adjacent to said end thereof; and a stepped wall which closes said end of the tubular wall said stepped wall comprising first, second and third step portions, said second step portion being disposed between said first and third step portions, said second step portion protruding axially into the waveguide further than said first step portion, and said third step portion protruding axially into the waveguide further than said second step portion.

2. A transducer as in claim 1, in which:

said end portion of the center conductor protrudes into the waveguide through the tubular wall in a transverse direction.

3. A transducer as in claim 1, in which:

said end portion of the center conductor protrudes into the waveguide through the tubular wall in a transverse direction; and said second step portion is spaced from said first step portion and said third step portion is spaced from said second step portion in said transverse direction.

4. A transducer as in claim 1, in which:

said end portion of the center conductor protrudes into the waveguide through the tubular wall in a transverse direction; and said third step portion is spaced from said second step portion and said second step portion is spaced from said first step portion in said transverse direction.

5. A transducer as in claim 1, in which the tubular wall has a rectangular inner cross-section.

6. A coaxial-to-waveguide transducer, comprising:

a waveguide including an elongated tubular wall having an end;

a coaxial cable including a center conductor having an end portion which protrudes into the waveguide through the tubular wall adjacent to said end thereof; and a stepped wall which closes said end of the tubular wall, said stepped wall including at least three step portions which protrude axially into the waveguide by different distances.

7. A transducer as in claim 6 in which:

said end portion of the center conductor protrudes into the waveguide through the tubular wall in a transverse direction.

8. A transducer as in claim 7 further comprising seal means disposed around said end portion of the center conductor for hermetically isolating the coaxial cable from the interior of the waveguide.

9. A transducer as in claim 8 in which the seal means comprises a ceramic dome window which sealingly fits over said end portion of the center conductor.

10. A coaxial-to-waveguide transducer, comprising:

a waveguide including an elongated tubular wall having an end;

a coaxial cable including a center conductor having an end portion which protrudes transversely into the waveguide through the tubular wall adjacent to said end thereof; and a stepped wall which closes said end of the tubular wall, said stepped wall including first and second block-shaped step portions, said first block-shaped step portion protruding axially into the waveguide further than said second block-shaped step portion.

11. A transducer as in claim 10 further comprising seal means disposed around said end portions of the center conductor for hermetically isolating the coaxial cable from the interior of the waveguide.

12. A transducer as in claim 11 in which the seal means comprises a ceramic dome window which sealingly fits over said end portion of the center conductor.

* * * * *